US010863804B2

(12) United States Patent
Shintani et al.

(10) Patent No.: US 10,863,804 B2
(45) Date of Patent: Dec. 15, 2020

(54) ERGONOMIC HANDLES FOR MOBILITY AND REHABILITATION DEVICES

(71) Applicant: URBAN POLING INC., North Vancouver (CA)

(72) Inventors: Mandy Shintani, North Vancouver (CA); Jocelyn Clennett, North Vancouver (CA); Diana Oliver, Etobicoke (CA)

(73) Assignee: URBAN POLING INC., North Vancouver (CA)

( * ) Notice: Subject to any disclaimer, the term of this patent is extended or adjusted under 35 U.S.C. 154(b) by 0 days.

(21) Appl. No.: 16/083,882

(22) PCT Filed: Mar. 7, 2017

(86) PCT No.: PCT/CA2017/050309
§ 371 (c)(1),
(2) Date: Sep. 10, 2018

(87) PCT Pub. No.: WO2017/152281
PCT Pub. Date: Sep. 14, 2017

(65) Prior Publication Data

US 2019/0216186 A1 Jul. 18, 2019

(30) Foreign Application Priority Data

Mar. 8, 2016 (CA) ..... CA 2923196

(51) Int. Cl.
*A45B 9/02* (2006.01)
*B25G 1/10* (2006.01)
*A63C 11/22* (2006.01)

(52) U.S. Cl.
CPC ..... *A45B 9/02* (2013.01); *A63C 11/221* (2013.01); *A63C 11/222* (2013.01); *B25G 1/102* (2013.01)

(58) Field of Classification Search
CPC ... G05G 1/04; G05G 1/06; G05G 1/10; B25G 1/102; A45B 9/02; A63C 11/221; A63C 11/222
(Continued)

(56) References Cited

U.S. PATENT DOCUMENTS 3,085,814 A * 4/1963 Scott ..... A63C 11/222 280/821
3,479,045 A * 11/1969 Miller ..... A63C 11/222 280/821
(Continued)

FOREIGN PATENT DOCUMENTS

DE 29900206 U1 * 1/2000 ..... A45B 9/02
DE 202014000659 U1 * 3/2014 ..... A63C 11/221
(Continued)

*Primary Examiner* — Adam D Rogers

(57) ABSTRACT

The invention provides an ergonomic handle for a mobility device comprising a central column grip region that has its lower portion extend outwards, forming a support ledge, for an ulnar portion of a user's hand upon the hand gripping the central column grip region, that extends substantially perpendicular to a longitudinal axis of the central column grip region, surrounding the lower portion of the grip region, the handle having a slit cavity that splits the support ledge and extends upward into the central column grip region, and the support ledge having an incline ledge portion that is sloped downward at a rear area of the support ledge.

16 Claims, 14 Drawing Sheets

(58) Field of Classification Search
USPC ..... D3/12
See application file for complete search history.

(56) References Cited

U.S. PATENT DOCUMENTS

| | | | | | |
|---|---|---|---|---|---|
| 4,172,601 | A * | 10/1979 | Hutter | B25D 7/00 | 280/816 |
| 4,730,632 | A * | 3/1988 | Mace | A45B 9/02 | 135/72 |
| 4,953,862 | A * | 9/1990 | Uke | A63B 60/10 | 473/538 |
| 5,287,870 | A * | 2/1994 | Rhodes | A45B 9/02 | 135/65 |
| 5,470,108 | A * | 11/1995 | Goode | A63C 11/222 | 135/75 |
| 7,758,455 | B2 * | 7/2010 | Thomas | A63B 49/08 | 473/459 |
| 8,123,252 | B2 * | 2/2012 | Lenhart | A45B 9/02 | 16/436 |
| 8,276,943 | B2 * | 10/2012 | Best | A63C 11/221 | 135/65 |
| D775,926 | S * | 1/2017 | Atkins | D8/303 | |
| 10,064,463 | B2 * | 9/2018 | Kreis | A45B 9/02 | |
| 2010/0254751 | A1 * | 10/2010 | McMillan, III | A45B 9/00 | 403/109.1 |

FOREIGN PATENT DOCUMENTS

| | | | | |
|---|---|---|---|---|
| EP | 2168641 | A1 * | 3/2010 | A45B 9/02 |
| FR | 2497675 | A2 * | 7/1982 | A63B 29/08 |

* cited by examiner 14
28
26
24
10
16
22
30

PRIOR ART 46
42
52
40
12
50
PRIOR ART 11
32
58
32
36
58

34
38
PRIOR ART (except 11)

ERGONOMIC HANDLES FOR MOBILITY AND REHABILITATION DEVICES

FIELD OF INVENTION

This invention relates to a novel device in the general field of handles used with portable pole devices to assist with fitness walking and mobility rehabilitation, and more specifically to handles with specific ergonomic structure which permits improved support, comfort, stability, safety and flexibility.

BACKGROUND OF THE INVENTION

Devices used to assist with mobility and rehabilitation (mobility devices) have included canes, walkers, wheelchairs, and more recently, urban, fitness, or Nordic walking poles. The deficiencies of these prior art mobility devices will now be discussed. The most common devices used to assist walking are canes and walkers. In 2011, about one-quarter of American adults aged 65 years and older used mobility devices—such as canes, walkers, and wheelchairs and this percentage of use has been increasing in recent years (Gell et al., 2015—the bracketed references in this Background of the Invention section are appended with bibliographic detail below). Many older adults have a negative perception of canes and walkers as implying disability and this perceived stigma deters mobility aid use (Resnick et al., 2009).

Existing walker designs do not promote an upright posture, causing the user to hunch over both handles, and prevent the normal walking pattern of alternating arm and leg swing as well as the engagement of upper extremity muscles. Single canes do not have bilateral support and therefore do not promote a normal walking pattern. A single cane can severely affect optimal posture by forcing the user to lean to one side. A single cane user's cane-side arm-swing is very limited, which also severely compromises optimal motion. In recent years, Nordic walking poles have been used for rehabilitation purposes as well as for basic mobility and fitness walking. It has been discovered that the use of walking poles increases the persistence and intensity of exercise (Tschentscher et al., 2013). There are over 164 studies listed on PubMed and other journals demonstrating the benefits of Nordic walking poles for less active older adults, those with chronic conditions and post-surgery. Nordic walking poles exercise the upper body muscles which results in a 20% increase in caloric intake versus regular walking which only uses the lower extremity muscles (Church et al. 2002). Nordic walking poles also provide bilateral support to improve balance and support an upright posture (Tschentscher et al., 2013).

Traditional Nordic walking poles are designed so that the user must apply a downward force on the pole strap adjacent to the handle by extending their wrist and this causes excessive and harm-causing strain on the wrist joint. In addition, the pole strap has been identified as a likely cause for the most common injury related to Nordic walking, strain or tearing of the ulnar collateral ligament of the thumb after a fall when the user is still attached to the poles (Knobloch & Vogt, 2006). Two handle designs that attempt to improve on how traditional Nordic walking poles are used include the Exerstrider (a trademark of Exerstrider Products Inc., Monona Wis., USA) shown in FIG. 8*a* and the Pacerpole (a trademark of Pacerpole Ltd, Windermere, UK), shown in FIG. 8*b*.

The strapless Exerstrider handle (FIG. 8*a*) is more advanced than traditional Nordic walking poles that use a strap, by using an ergonomic central column with a lateral lip for applying a downward force with the hand in a more neutral position than prior designs. However, the lateral lip is inadequate to provide enough support for an even distribution of force on the ulnar portion of the hand and to support the wrist in a sufficiently neutral position when hand exertion is higher, for example when the legs of a rehabilitation user are weak, or when a hiker attempts to distribute more weight to his hands on a steep incline (Arnold, 2016). That design also limits the ability of the heel of the hand to provide much downward force for weight-bearing to reduce off-loading on the lower extremity joints, to increase balance, as well as for resistance training for core strengthening (Arnold, 2016). In the Exerstrider poles, the force exertion occurs at the small joints of the knuckles rather than on the heel of the hand (Arnold, 2016). Smaller joints are more prone to injury and strain and this would also reduce overall comfort. In addition, this handle only fits about 65% of the grip size of the male population (Arnold, 2012).

The Pacerpole handle design (FIG. 8*b*) positions the hand closer to a neutral position and provides increased surface area for applying a downward pressure, however the angle is so far forward that ulnar deviation occurs causing excessive wrist strain. Also, the line of force activation is off the pad of the thumb and thus less force can be engaged through to the poles (Arnold, 2012).

All of the above handles including traditional Nordic walking poles with straps, the Exerstrider handle and the Pacerpole, only provide one static sideways hand position during pole use, thereby limiting the adaptability of the handle for different user circumstances. There is extensive research showing reduced user fatigue when static hand contractions are reduced (Genaidy et. al., 1990; Demura et al., 2011; Finneran et al., 2013; Lim et. al., 2014). Alternate hand positions can alleviate fatigue from static hand contractions allowing users to extend their walking time and maintain gripping requirements, particularly for those with arthritis in their hand joints (Lim et al., 2014; Imrhan, 2007). Another design feature of the Nordic walking poles and the Pacerpole which can provide a challenge for use in rehabilitation is the segmented pole lock system which older adults with arthritis and individuals with neurological conditions affecting grip strength have difficulty securing. The maximum weight bearing capacity for a pole using a twist/turn lock system is about 90 pounds, while the flip lock system may support 150 pounds. By employing a more ergonomic wrist-supporting handle design, the load bearing capacity of each pole could be made higher in order to enable the user to offload even more downward force to the pole.

REFERENCES

Arnold, K-A. (2012). Ergonomic Analysis of Urban Poling Handle Designs Consulting Report; and Arnold, K-A. (2016). Ergonomic Analysis of Urban Poling Handle Design Consulting Report 2—www.urbanpoling.com Bechard, D., Birmingham, T., Jones, I., Mardosas, P., Martiuk, L., & Yeung, P. (2015). Effects of Walking Pole Technique on Knee Joint Loading. Unpublished manuscript. University of Western Ontario.

Church, T., Earnest, C., & Morss, G. (2002). Field Testing of Physiological Responses Associated with Nordic Walking. RQES; 77 (3):296-300

Demura S., Yamaji, S., Nagasawa, Y., & Nakada M. (2011). Different gripping intervals in reproducibility of force decreasing curve and muscle oxygen kinetics during sustained maximal contraction. Perceptual & Motor Skills; 112 (2):561-572.

Finneran, A., & O'Sullivan, L. (2013). Effects of grip type and wrist posture on forearm EMG activity, endurance time and movement accuracy International Journal of Industrial Ergonomics, 43 (1):91.

Finneran, A., & O'Sullivan, L. (2014). Self-selected duty cycle times for grip force, wrist flexion postures and three grip types. Ergonomics, 57 (4):589-601.

Gell, N., Wallace, R., LaCroix, A., Mroz, T., & Patel, K. (2015). Mobility Device Use in Older Adults and Incidence of Falls and Worry about Falling: Findings from the 2011-2012 National Health and Aging Trends Study. J Am Geriatr Soc.

Genaidy, A. M., Houshy, A R., & Asfour, S. S. (1990). Physiological and Psychophysical Responses to Static, Dynamic and Combined Arm Tasks. Applied Ergonomics, 21 (1):63-67.

Imrhan, S. N. (2006). Hand grasping, finger pinching, and hand squeezing in Interventions, Controls, and Applications in Occupational Ergonomics; Etd Marras, W & Karwowski, W.

Knobloch, K., & Vogt, P M. (2006). Nordic pole injuries—nordic walking thumb as novel injury entity. Sportverletz Sportschaden; 20 (3):137-42.

Lim, C-M., & Kong, Y-K. (2014). Effects of the resting time associated with the number of trials on the total and individual finger forces in a maximum grasping task. Applied Ergonomics, 45 (3):443-449.

Resnik, L., Allen, S., Isenstadt, D., Wasserman, M., & Lezzoni, L. (2009). Disabil Health J. April: 2 (2):77-85.

Tschentscher, M., Niederseer, D., & Niebauer, J. (2013). Health Benefits of Nordic Walking. Am J Prev Med; 44 (1):76-84.

BRIEF SUMMARY OF THE INVENTION

The presently disclosed novel handle has a prominent ledge that provides greater support for the ulnar portion of the heel and palm of the hand. This allows for an even distribution of force across the hand and for the user to maintain a neutral position of the wrist for higher rates of exertion, thus enabling increased comfort, increased support for downward pressure exerted on the handles, and therefore increased weight-bearing capacity for offloading off hips and knees, and increased stability as well as enhanced upper body and core strength. In addition, the handle design permits two ergonomic bidirectional top holding positions, and a wider range of grip sizes for users of a variety of ages and genders. The ledge increases force distribution and offloading of stress from the user's lower appendages. This is of particular advantage where the user's walking ability is compromised, or where the user encounters a slope to be walked and more force needs to be exerted from the user's hands through the handles and the poles to the ground beneath.

The present handle's features provide less radial deviation in the user's wrist than with prior poles' handles, a significant advantage when a slope is steep and more force needs to be exerted, or when, due to a user's extra weight or feebleness of the legs, more force needs to exerted from hands to poles.

The invention essentially provides an ergonomic handle for a mobility device comprising a central column grip region that has its lower portion extend outwards, forming a support ledge, for an ulnar portion of a user's hand upon the hand gripping the central column grip region, that extends substantially perpendicular to a longitudinal axis of the central column grip region.

In a preferred embodiment of the ergonomic handle, a) the support ledge substantially surrounds the lower portion of the grip region;

b) the handle has a slit cavity that splits the support ledge and extends upward into the central column grip region;

c) the support ledge has an incline ledge portion that is sloped downward at a rear area of the support ledge;

d) the central column grip region provides a side-holding position for a user's hand on the handle, the central column grip region having an upper portion that is joined to a pommel that provides provide a top-holding position for a user's hand on the handle; and e) the pommel is oval-shaped to provide bi-directional gripping of the pommel by a user's hand.

A flared sector on a dorsal aspect of the central column grip region fits the palm of a user's hand. Further enhancements are:

a) the central column grip region has a textured surface on the medial and lateral aspect of the central column grip region to increase resistance for a user's palm;

b) the slit cavity is swept upward in an arc from the support ledge and offset from, but parallel to, a longitudinal axis of the central column grip region, pole, the slit cavity being cut in to a depth of approximately 50% of a latitudinal thickness of the handle at a base of the arc, and cut in to a depth diminishing to zero depth at a top of the arc;

c) the support ledge is approximately 82 mm. in length from its front end to its dorsal end;

d) the ergonomic handle is made of thermoplastic rubber of 90A durometer in order to provide a balance of strength and flexibility in the central column grip region and in the support ledge.

In typical usage, the ergonomic handle would be paired with a second such handle, in which the ergonomic handle and the second such handle are symmetrically shaped to fit respective left and right hands of a user and the ergonomic handle and the second such handle are respectively mounted on each of a pair of walking poles, the walking poles being reinforced adjustable-length mobility pole with button lock securement of their respective pole length segments.

The handles thus allow increased user stability as well as enhancing upper body strength, and provide optimal ergonomic grip for a greater range of users. The presently disclosed handles were developed specifically for use with walking poles designed to support the greater downwards force possible and with a segmented pole locking mechanism that is easier and safer to use. The ledge on the handle is a successful ergonomic feature and provides a significant difference in terms of a more even force distribution across the hand for all sizes and activities. Spreading the distribution across the hand reduces contact stress. The ledge also allows for force to occur most effectively through the central rotation of the joint, which is the ulnar heel of the hand. This handle is particularly effective in "off-loading" for larger user who require a device for walking.

BRIEF DESCRIPTION OF THE DRAWINGS

FIG. 1*b* shows a bottom isometric left sided view of a left handed ergonomic handle.

DETAILED DESCRIPTION

All elements will now be introduced by reference to figures, then how each element functions and interacts with each other element will be described where necessary.

Figure 1A:
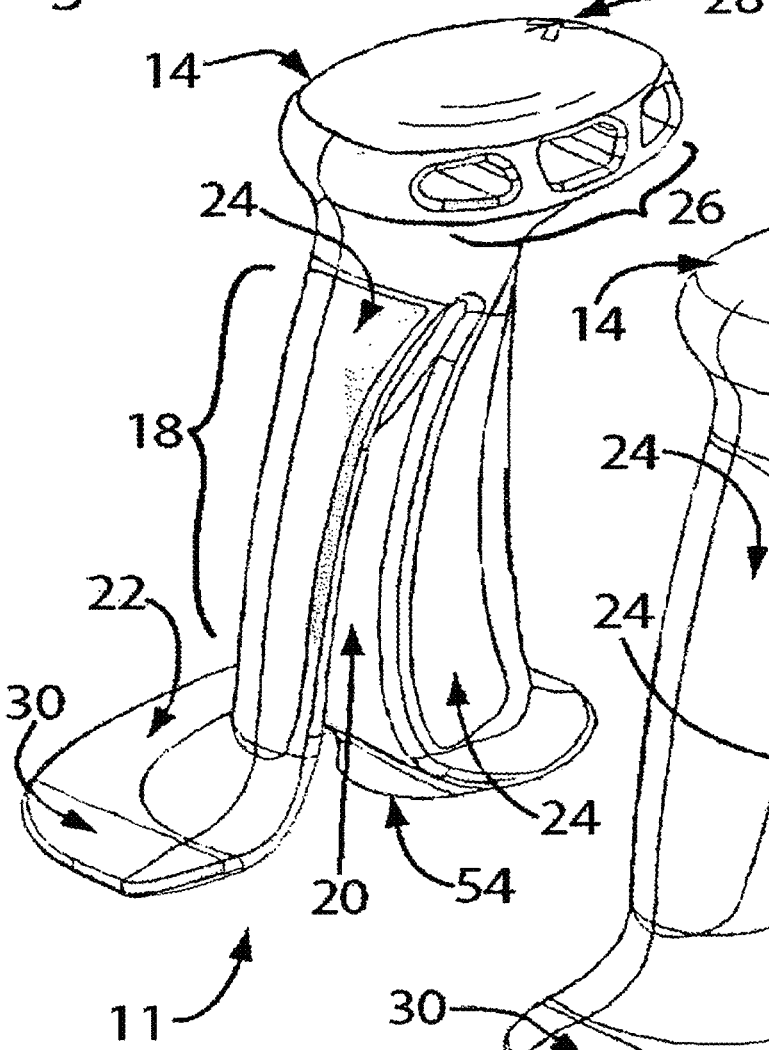
FIG. 1*a* shows a top isometric right sided view of a left handed ergonomic handle.
Figure 1B:
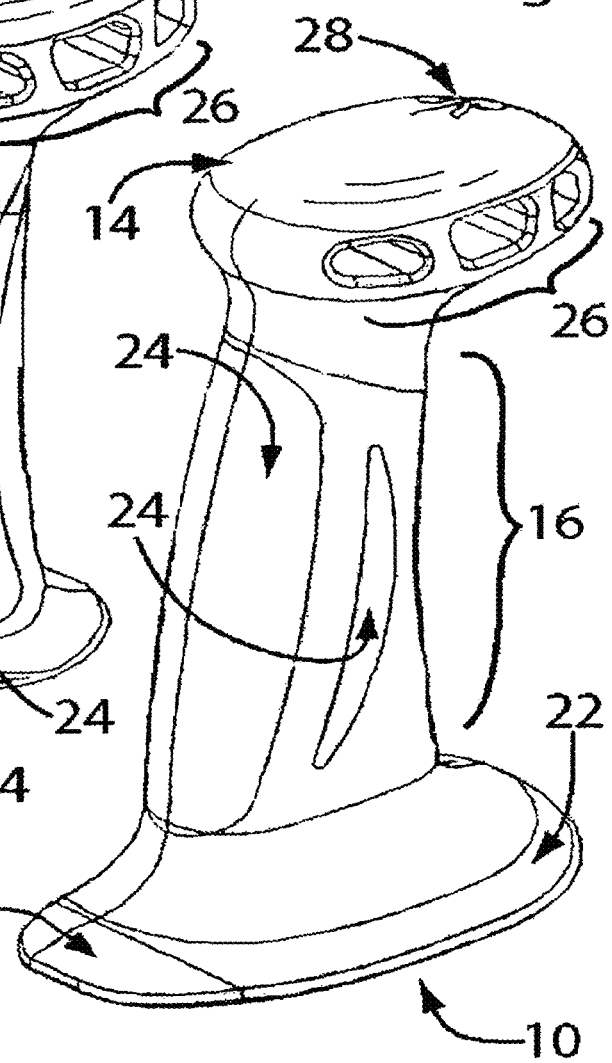
FIG. 1*b* shows a top isometric right sided view of a right handed ergonomic handle.
Figure 2A:
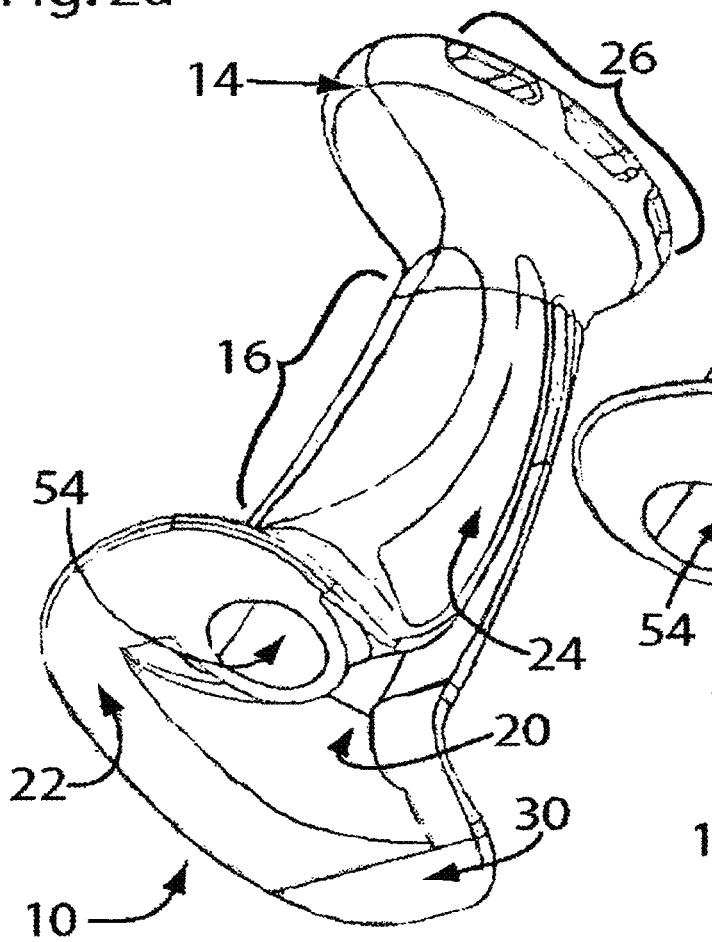
FIG. 2*a* shows a bottom isometric left sided view of a right handed ergonomic handle.
Figure 2B:
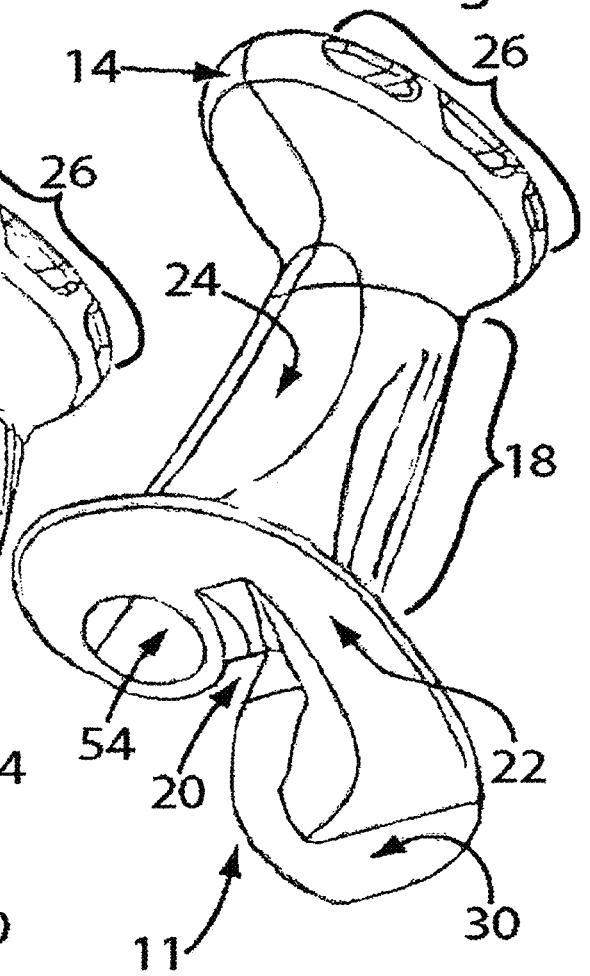
Figure 3A:
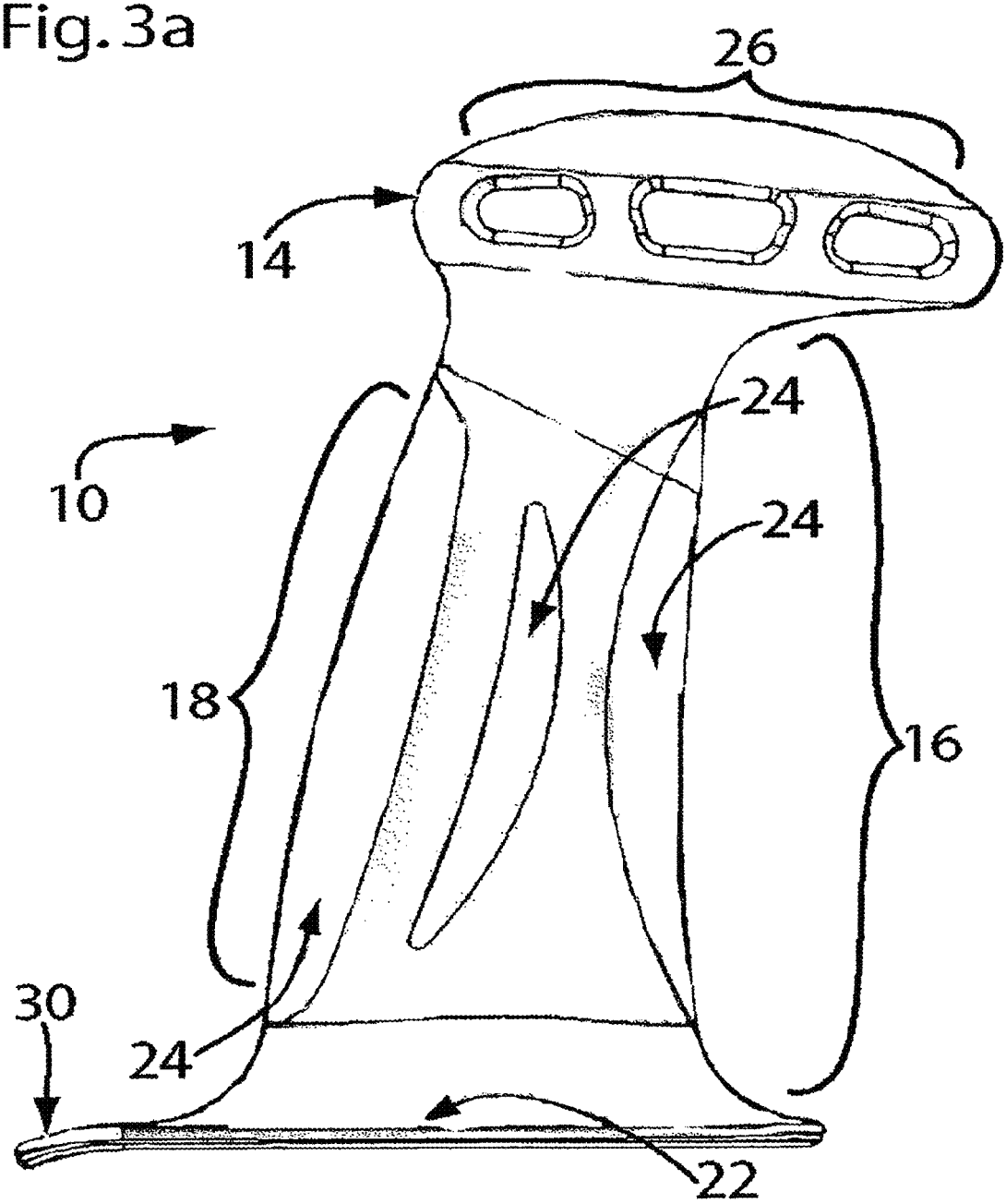
FIG. 3*a* shows a right side view of a right handed ergonomic handle.
Figure 3B:
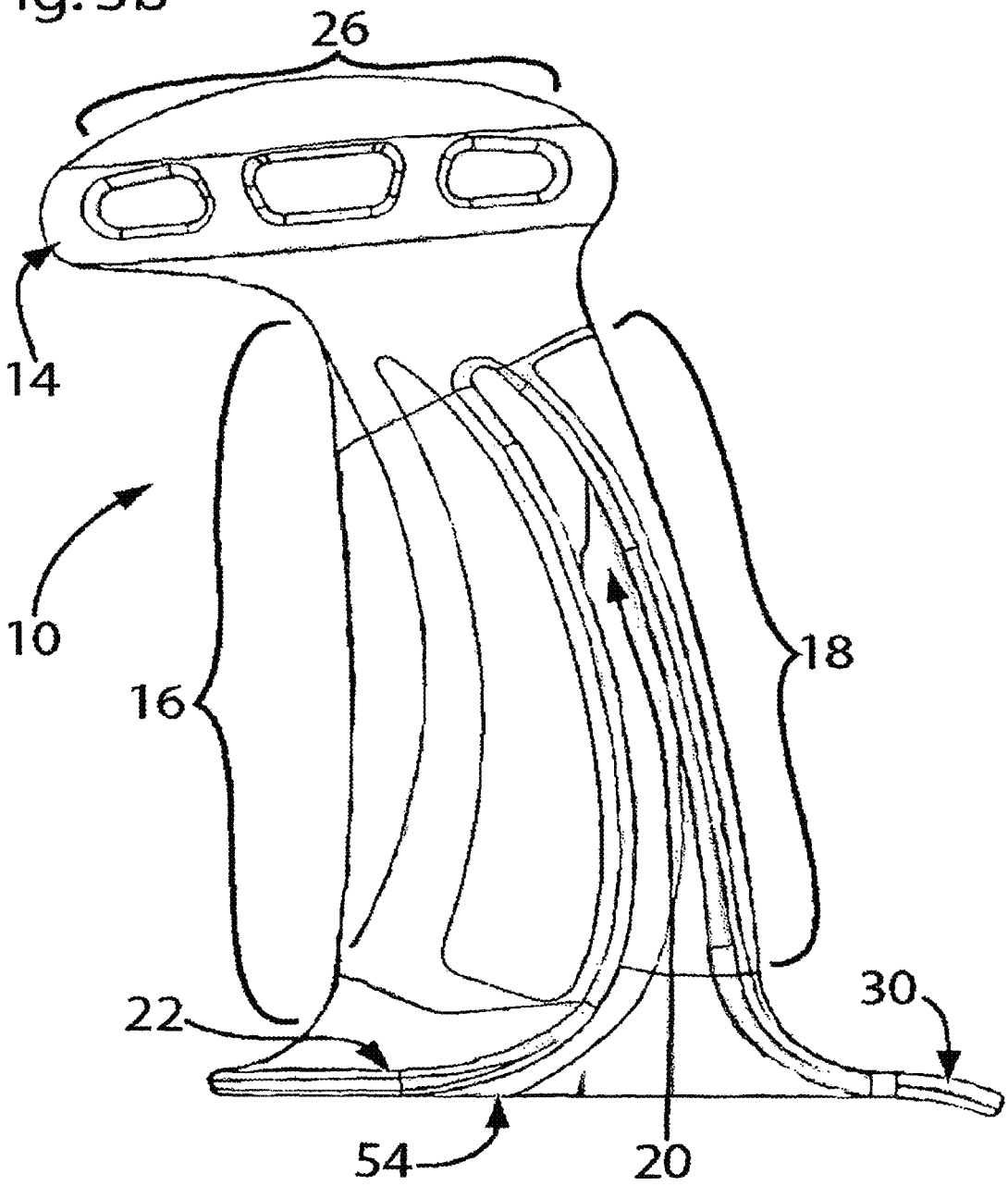
FIG. 3*b* shows a left side view of a right handed ergonomic handle.
Figures 4A, 4B:
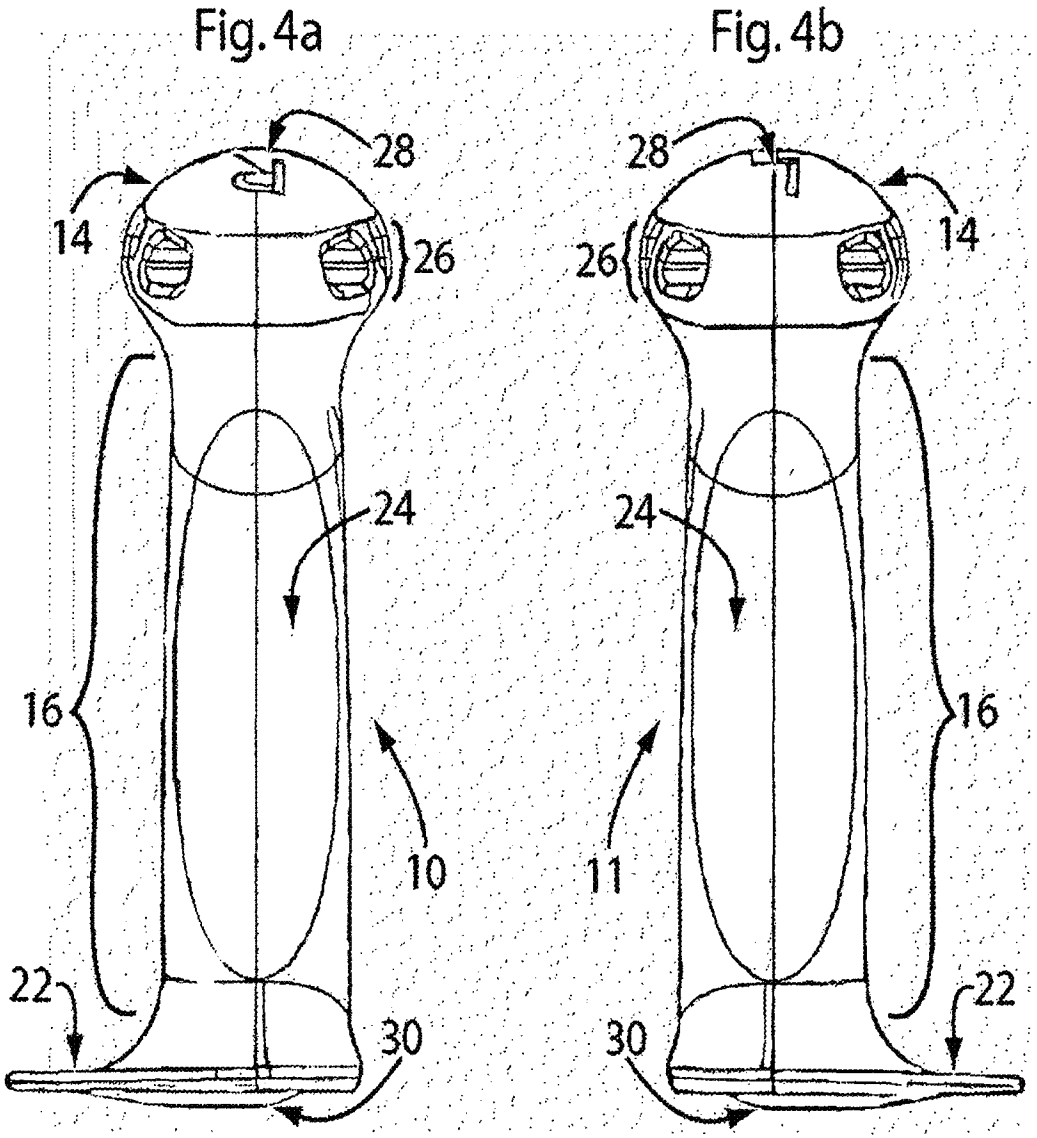
FIG. 4*a* shows a front view of a right handed ergonomic handle.
FIG. 4*b* shows a front view of a left handed ergonomic handle.
Figures 5A, 5B:
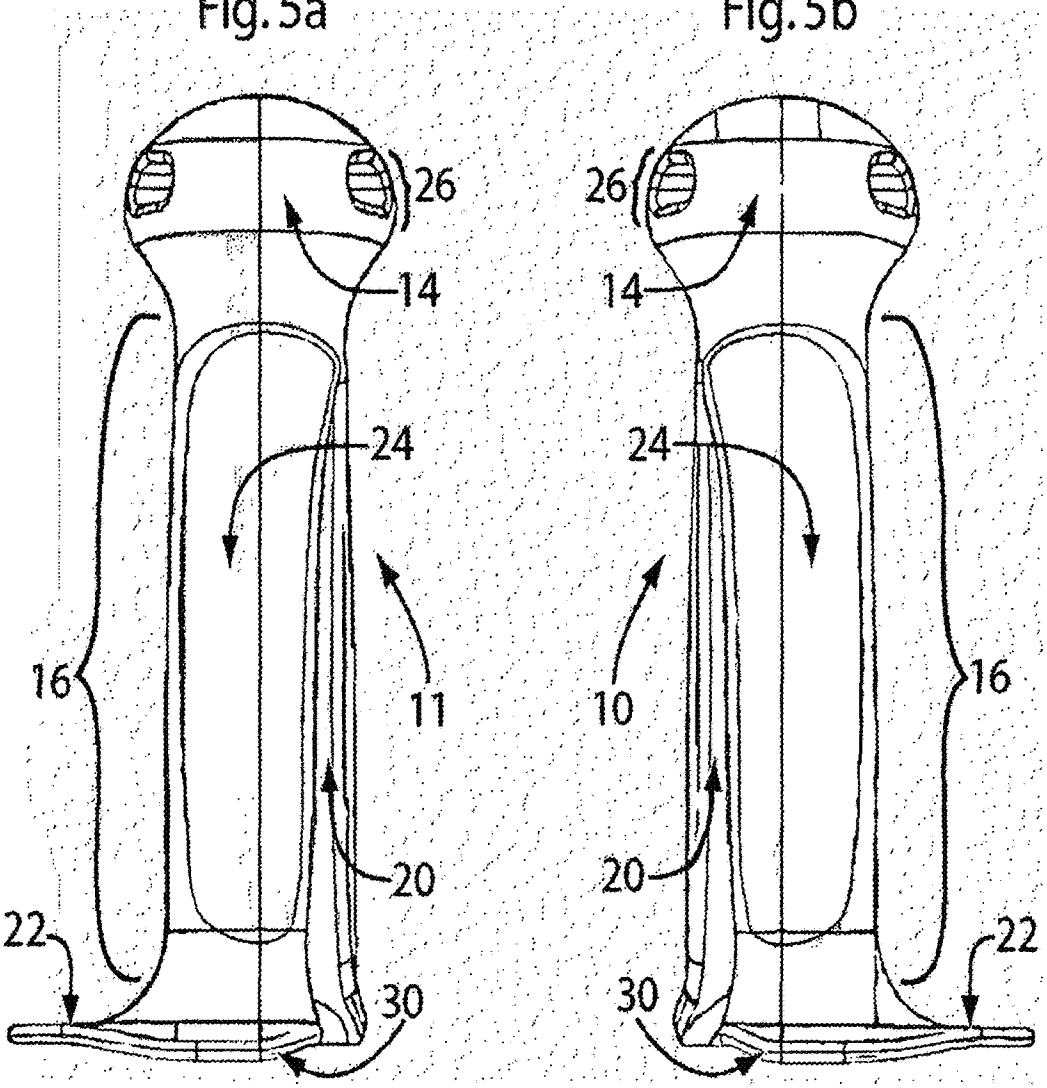
FIG. 5*a* shows a rear view of a left handed ergonomic handle.
FIG. 5*b* shows a rear view of a right handed ergonomic handle.
Figure 6B:
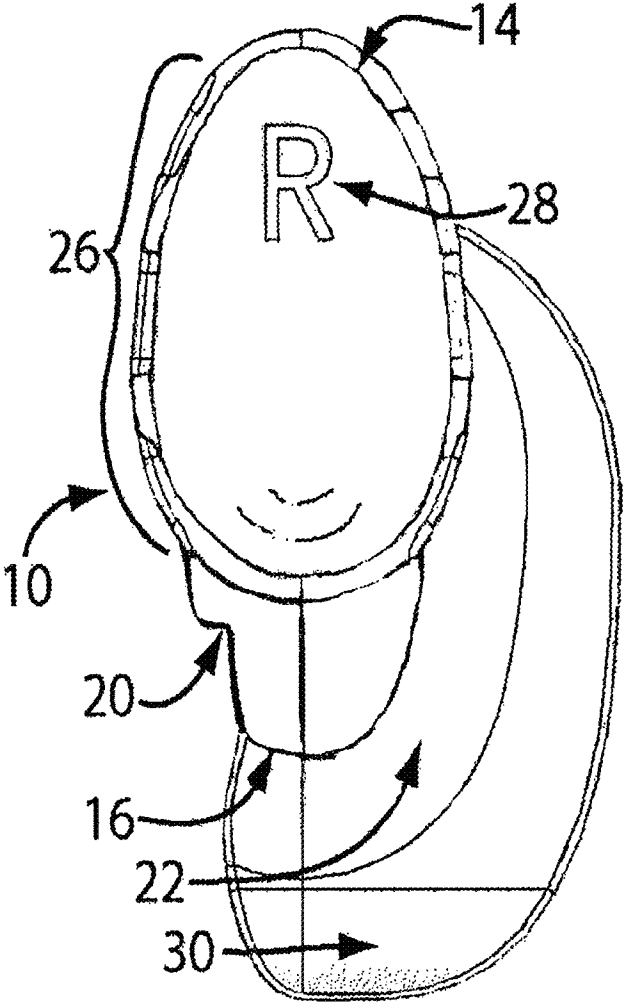
FIG. 6*b* shows a top view of a right handed ergonomic handle.
Figure 6A:
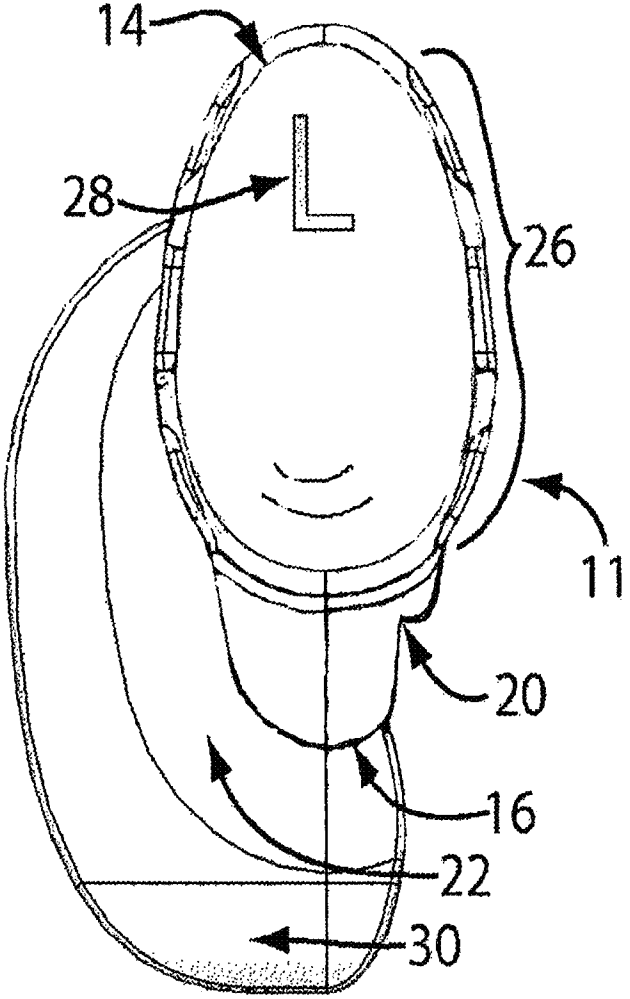
FIG. 6*a* shows a top view of a left handed ergonomic handle.
Figures 7A, 7B:
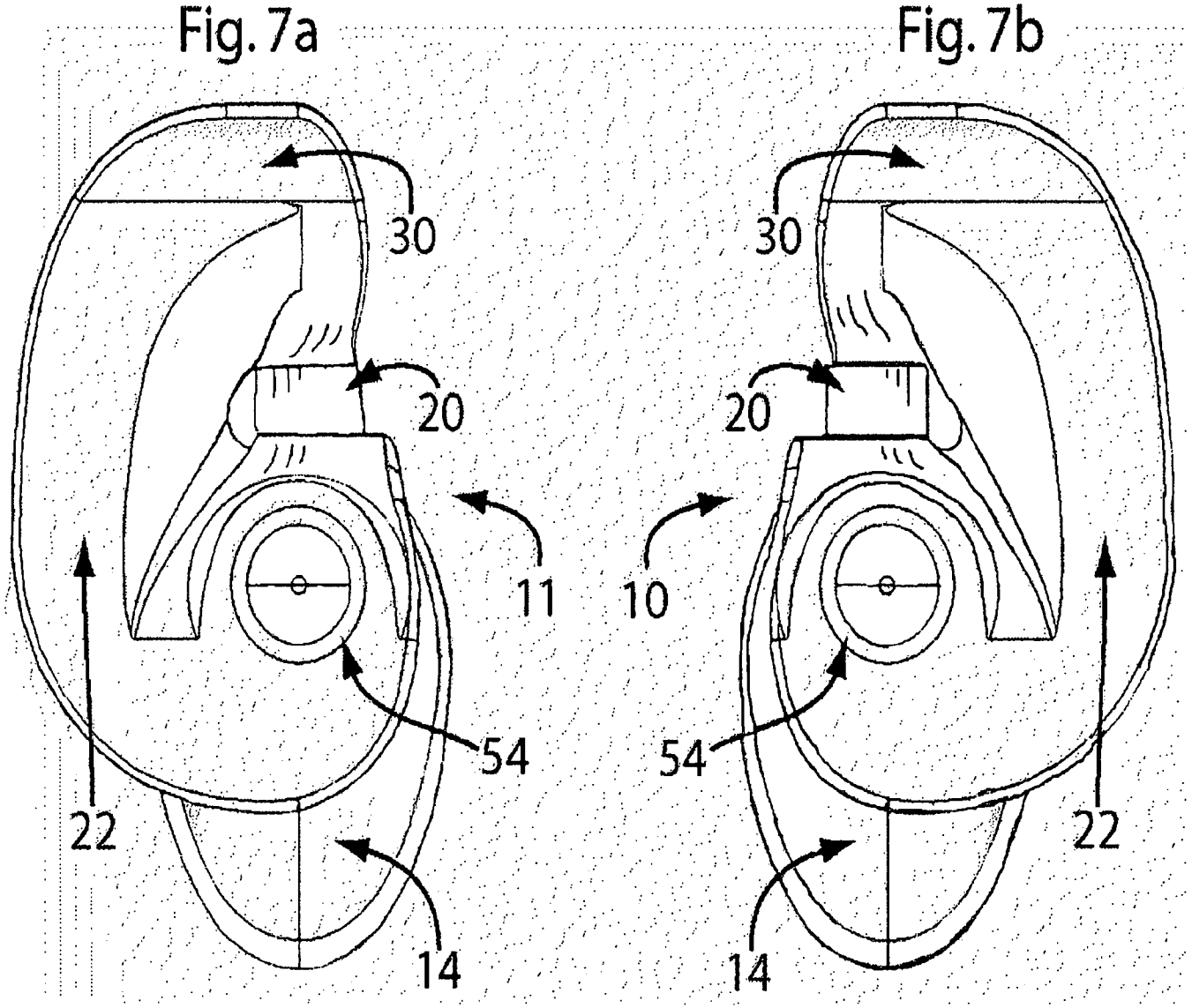
FIG. 7*a* shows a bottom view of a left handed ergonomic handle.
FIG. 7*b* shows a bottom view of a right handed ergonomic handle.

FIG. 1*a* shows a top isometric right sided view of a left handed ergonomic handle 11 with its bidirectional pommel 14, grip region 16, slit cavity 20, support ledge 22, textured surfaces 24, vents 26, handedness identifier 28, incline ledge 30, and pole receiver 54. FIG. 1*b* shows the same elements of a right handed ergonomic handle 10 from a top isometric right sided view. FIG. 2*a* shows a bottom isometric left sided view of a right handed ergonomic handle 10. FIG. 1*b* shows a bottom isometric left sided view of a left handed ergonomic handle 11. FIG. 3*a* shows a right side view of a right handed ergonomic handle 10. FIG. 3*b* shows a left side view of a right handed ergonomic handle 10. Note that the flared sector 18 refers to the ergonomic shape and angle of the rear side of the grip region 16. FIG. 4*a* shows a front view of a right handed ergonomic handle 10. FIG. 4*b* shows a front view of a left handed ergonomic handle 11. FIG. 5*a* shows a rear view of a left handed ergonomic handle 11. FIG. 5*b* shows a rear view of a right handed ergonomic handle 10. FIG. 6*a* shows a top view of a left handed ergonomic handle 11. FIG. 6*b* shows a top view of a right handed ergonomic handle 10. FIG. 7*a* shows a bottom view of a left handed ergonomic handle 11. FIG. 7*b* shows a bottom view of a right handed ergonomic handle 10.

Figure 8A:
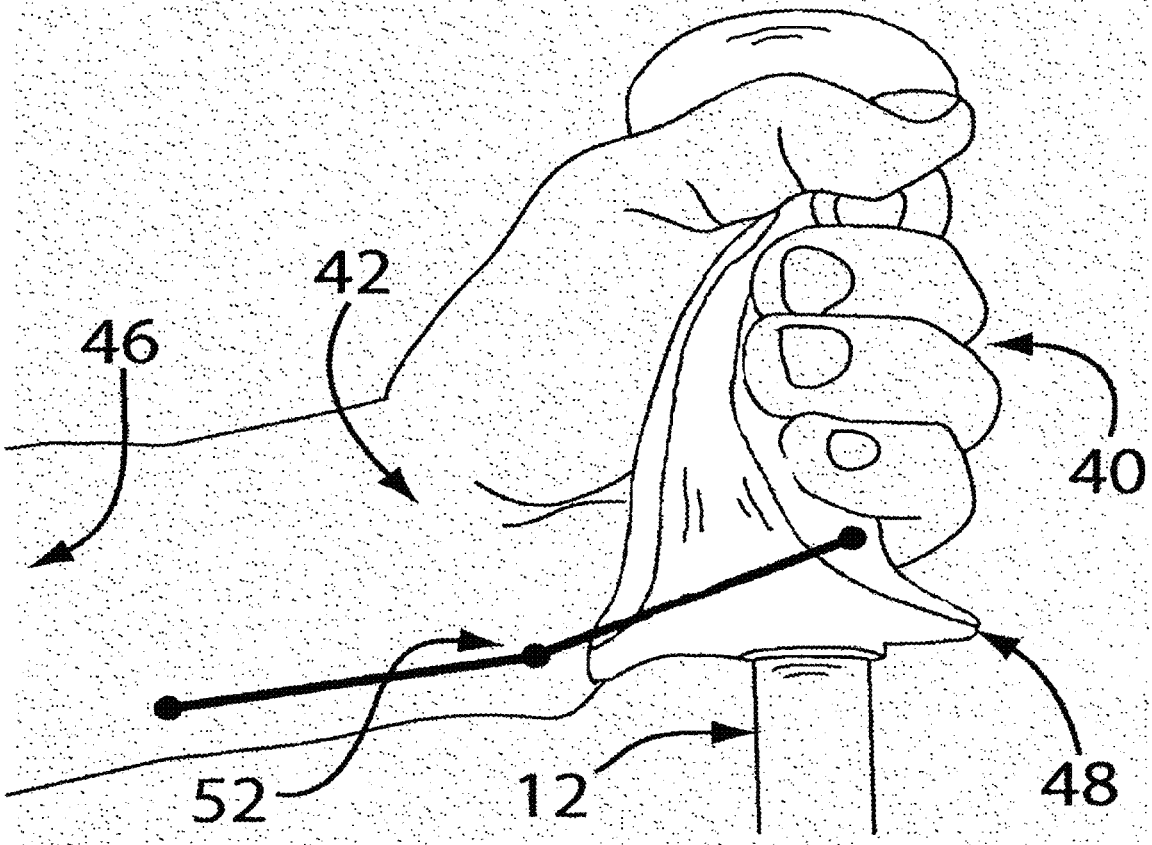
FIG. 8*a* shows a side view of a hand using prior art handle A with FIG. 8*b* showing a side view of a hand using prior art handle B.
Figure 8B:
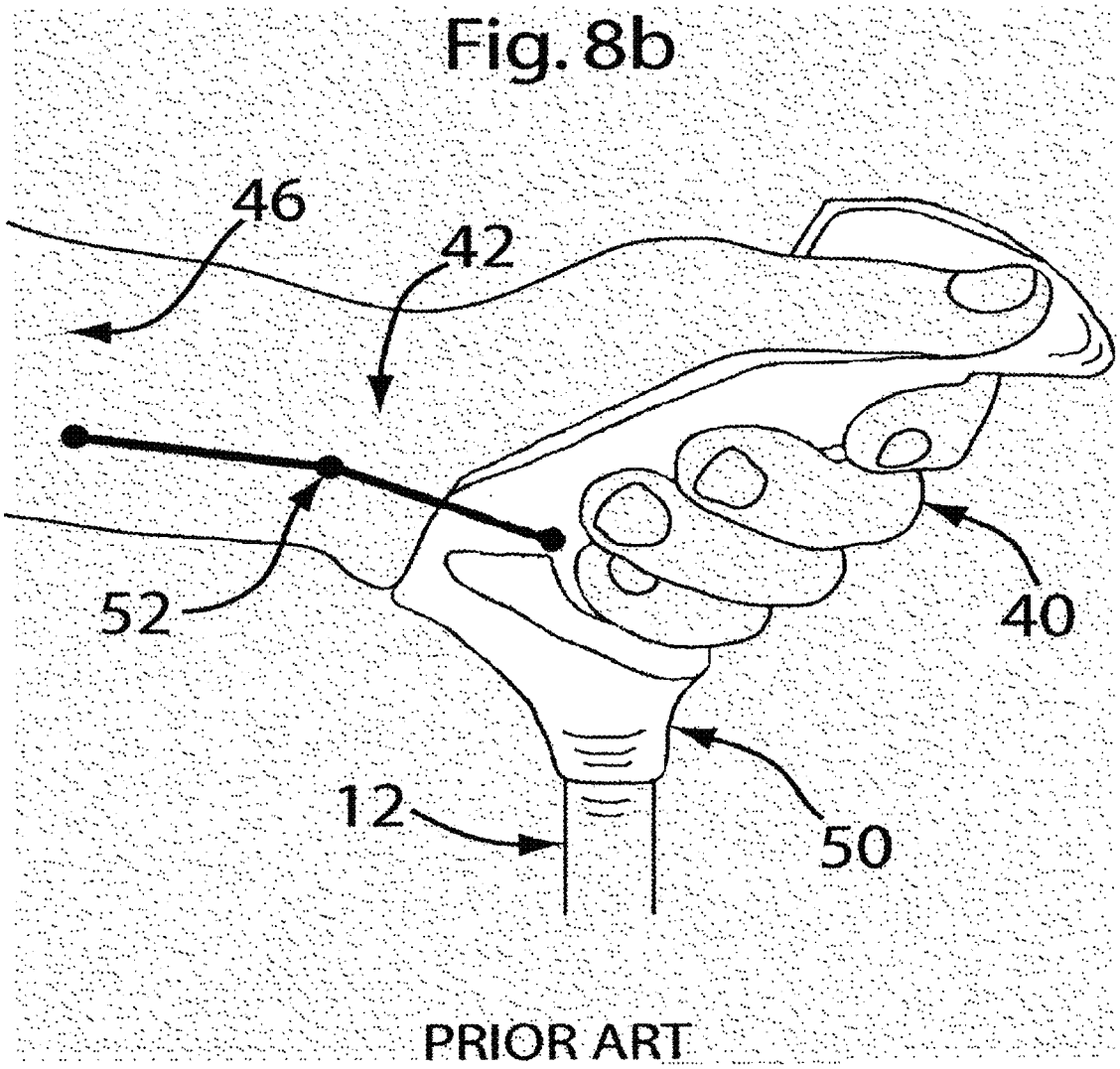
FIG. 8*c* shows a side view of a hand using the disclosed ergonomic handle. Each figure illustrates the angle of deflection of the user's wrist when using each handle, as well as the level of mechanical support provided by each handle.
Figure 8C:
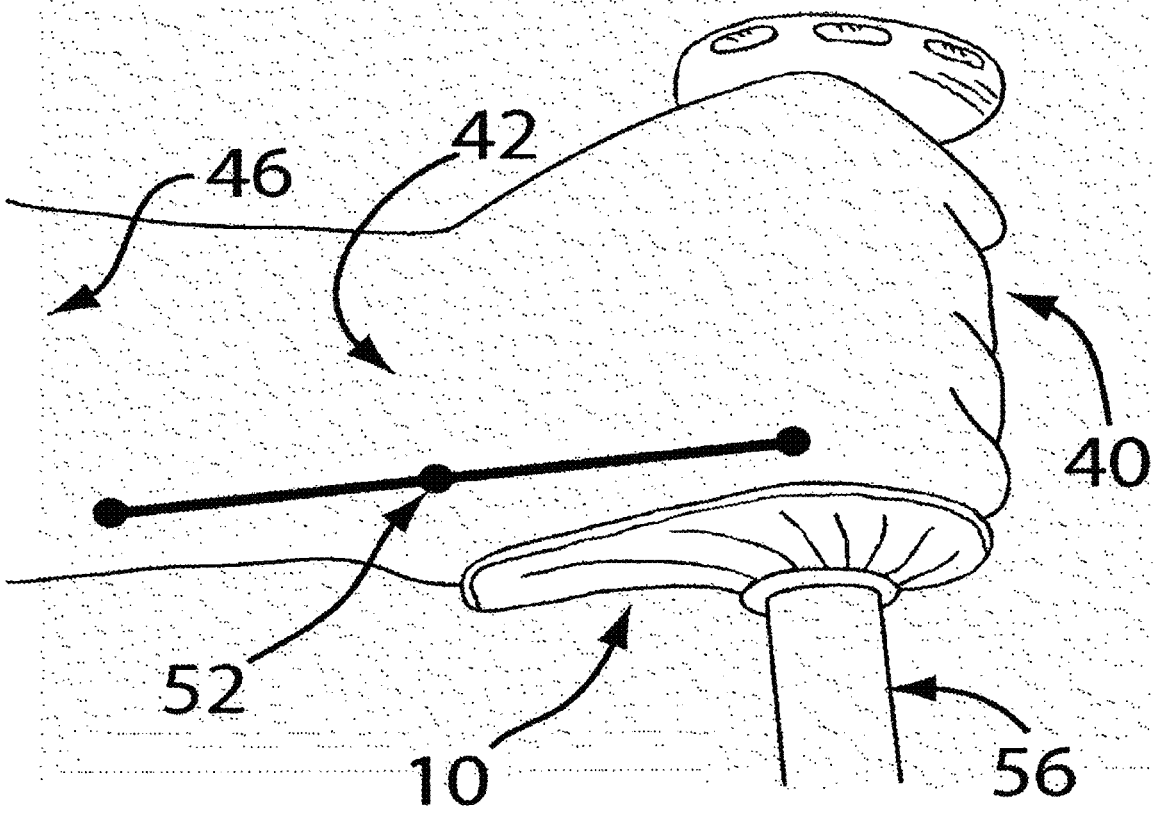
Figure 9A:
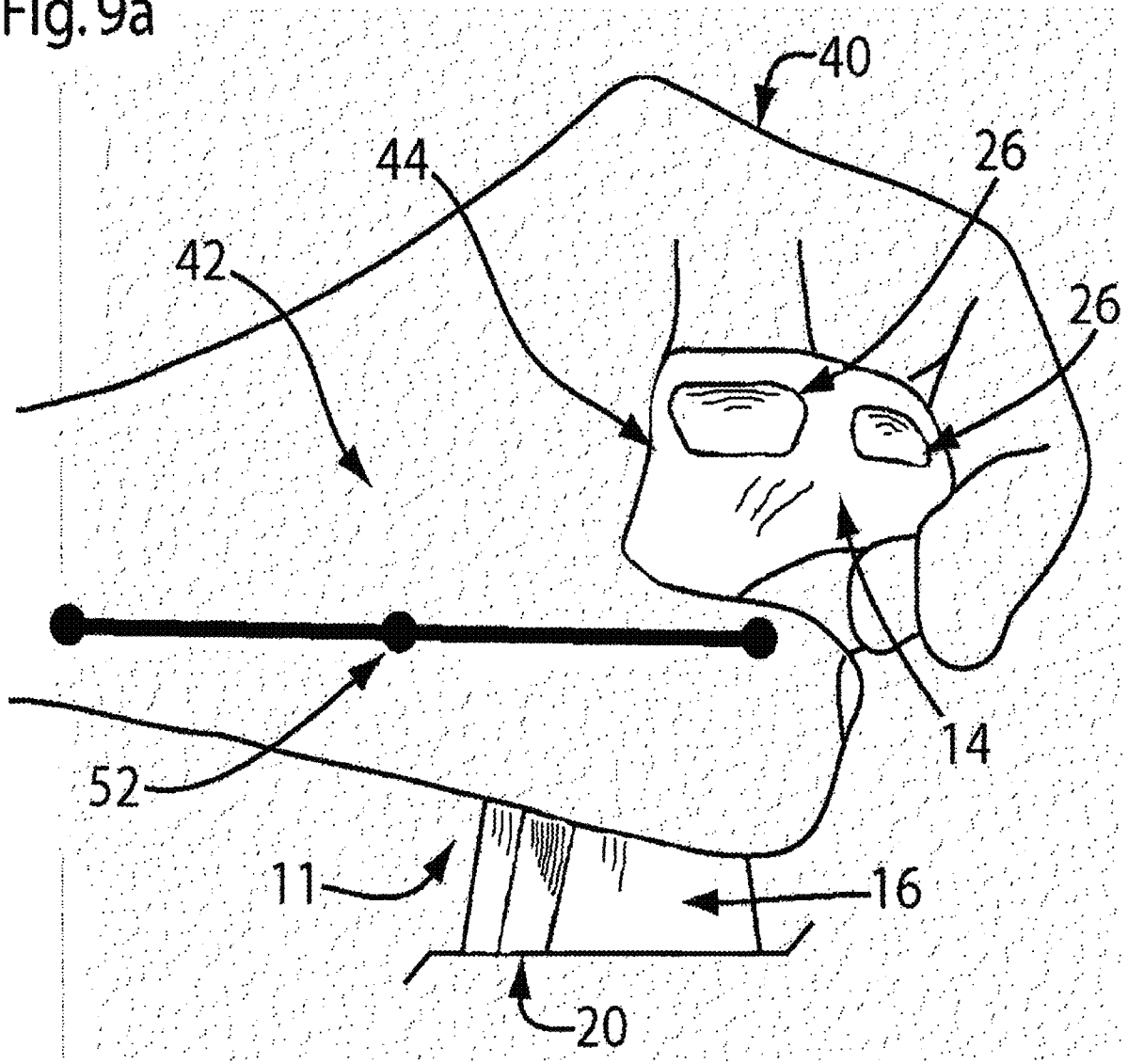
FIG. 9*a* shows a side view of a user's hand as it grasps the pommel of the ergonomic handle as it faces forward, and in FIG. 9*b*, from the side.
Figure 9B:
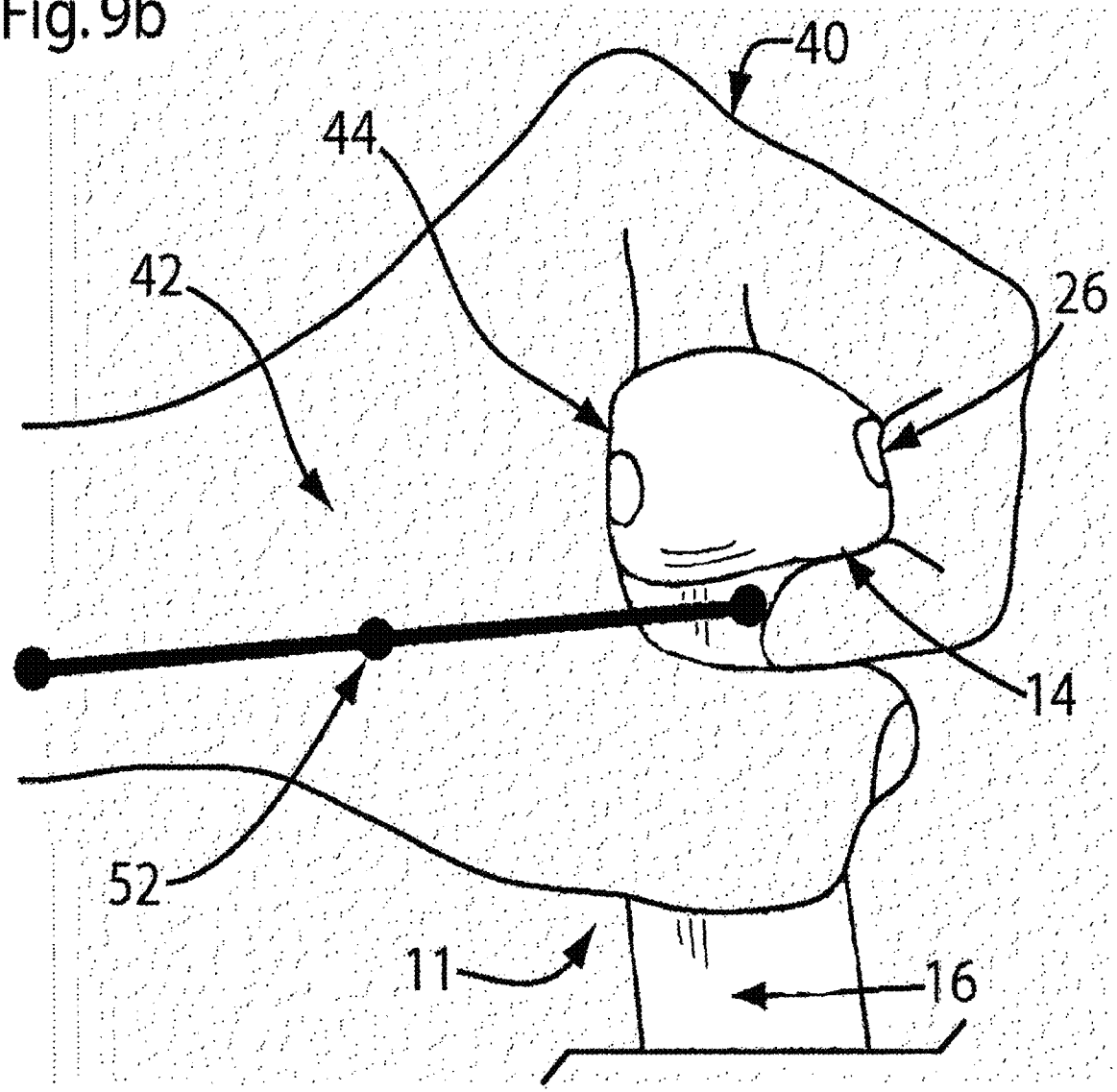
Figures 10A, 10B:
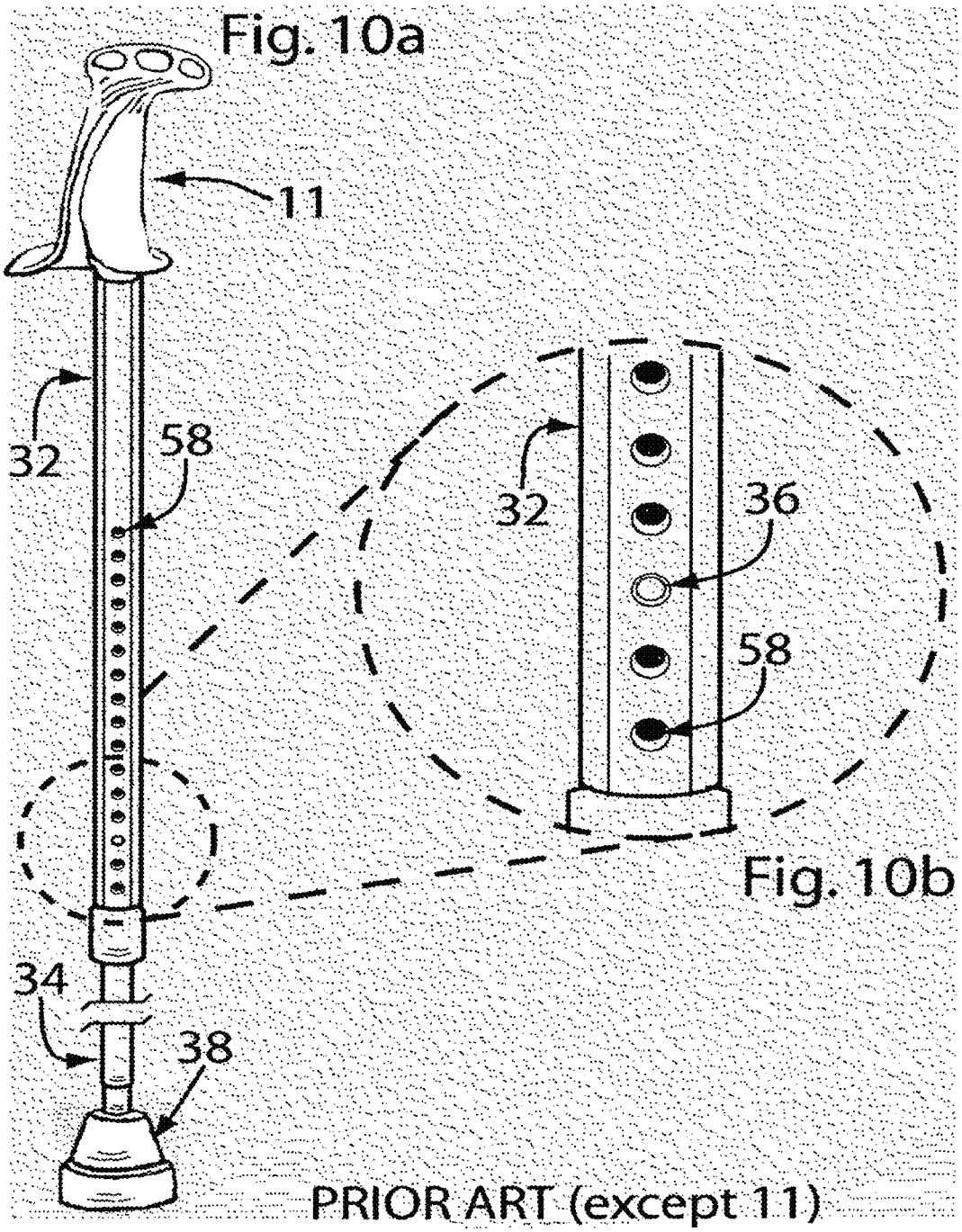
FIG. 10*a* shows a side view of a left handed ergonomic handle using a reinforced mobility pole with button lock securement.
FIG. 10*b* shows a close-up of the securement means.

FIG. 8*a* shows a side view of prior art handle A 48 on pole 12 and illustrating the deviation angle 52 of the wrist 42 between the arm 46 and hand 40 (showing the fingers vs the heel of the hand, which is the area on the ulnar part of the hand just before the wrist). FIG. 8*b* shows a side view of prior art handle B 50 on pole 12 and illustrating the deviation angle 52 of the wrist 42 between the arm 46 and hand 40. FIG. 8*c* shows a side view of a hand 40 grasping the disclosed ergonomic handle 10 on a reinforced mobility pole 56 and illustrates a lack of wrist 42 deviation 52. FIG. 9*a* shows a side view of a user's hand 40 as it grips the pommel 14 (shaped to fit their palm 44) of the ergonomic handle 11 from behind, and in FIG. 9*b*, from the side. FIG. 10*a* shows a side view of a left handed handle 11 on a prior art reinforced mobility pole, with a distal section 34 sliding into a proximal section 32, and secured through button lock holes 58 in the latter by means of a button lock 36 protruding from the former. Also shown is a bell shaped balance tip 38 at the end of the distal section 34. FIG. 10*b* shows a close-up of the region where the button lock 36 is secured through a button lock hole 58 in the proximal section 32.

The preferred embodiment of the disclosed Ergonomic Handles for Mobility & Rehabilitation Devices will now be described in detail in the following order, namely: Pommel, Grip, Flare, Ledge(s) and Pole Selection.

The Pommel

The top of each handle (10 or 11), the bidirectional pommel 14 was designed to allow for top holding as well as the sideways grip so as to provide an alternative position to reduce user fatigue particularly for those with arthritis in their hand joints. During the top holding there is no force on the ulnar heel hand which is used during the sideways grip. The oval shape of the pommel 14 and the anterior inferior aspect of the head is small enough to fit comfortably in the palm 44 of the hand 40 in either a vertical position (FIG. 9*a*) or horizontal position (FIG. 9*b*) for male and female users while maintaining the wrist 42 in a neutral position as shown by the deviation angle indicator 52. Pressure can be placed on the pommel 14 for weight bearing when descending stairs when a railing is not available and on steeper hills. Ergonomic wrist angle (see FIG. 9*a*) is made possible by the shape of the pommel 14 and allows the user to maintain an upright posture so as to maintain balance rather than being forced to bend forward to grasp the handle in a sideways grip which forces the wrist into extreme radial deviation. It also allows users to be more efficient with their force exertions as the centre of force exertion is closer to the centre of the pole. Forces are higher for top holding on the handle compared to side holding for stairs which shows this is an effective position for off-loading.

By using high density rubber, three wide vents 26 can pass through the top horizontal plane of the pommel 14 (FIG. 1*b*, 3*a*), providing shock absorption while maintaining the structural strength for top or side holding and better grip. To assist older adults with reduced vision, there is a large R and L on the top of each pommel 14 to easily identify the correct right and left handle. (FIGS. 6*a* & 6*b*)

The Grip

The Grip Region 16 is the central column which is ergonomically shaped for a right and left hand grip and a range of female and male users. The ergonomic grip promotes maintaining a loose hand grip which is less stressful on joints for those with arthritis and helps prevent repetitive strain injuries. Downward force of the user's hand is cradled by the Support Ledge 22 which allows the wrist 42 to remain in a neutral position with even force being distributed through the hand rather than the user using a tight grip on the central column. Due to the curved shape of the anterior inferior aspect of the pommel 14 there is more surface area on the grip region 16 for the hand 40 size of male users compared to that available with the Exerstrider grip. The handle length is now 950 mm in length which accommodates about 100% of females and 99% of male hands. The handles (10 or 11) include textured surfaces 24 on the medial and lateral aspect of the grip region 16 to increase resistance for the palm 44 and hand 40 when sweaty.

The Flare

A split handle design (FIG. 3*b*) is provided by a swept upward slit cavity 20, offset from, but parallel to, the longitudinal axis of the pole and cut in at approximately 50% depth, diminishing to zero as it reached the top of the arc. In addition, the shape of the dorsal aspect of the grip region 16, made possible by the shape of the cavity 20 is known as the flared sector 18, and provides ergonomic support for the palm 44 when combined with the support ledge 22. The slit cavity 20 in the grip region 16 also improves athletic esthetics which increases persistent usage and allows for vibration dampening to protect the wrist 42 from excess strain or tension.

The Ledge(s)

The Support Ledge 22 (FIG. 1*b*) extends from the base of the grip region 16 and was designed to support even force distribution on the ulnar portion of the heel of the hand 40 (FIG. 8*c*). The length of the ledge 22 was increased significantly over the prior art in order to support the heel of the hand 40 in a neutral position while minimizing strain on the wrist 42 joint. The length of the ledge is 82 mm. Given that the ledge should be no more than 25 mm from the wrist crease to optimize force and comfort, it has been determined that the ledge length accommodates about 100% of females and 85% of males. In addition, there is a slight slope at the rear of the ledge 22 under the heel of the hand known as the incline ledge 30 which comfortably allows the user to apply a downward force (FIG. 3*a*) on the handle when the poles are vertically inclined forwards. Increasing the surface area supporting the heel of the hand 40 and strengthening the ledge 22 increases the total magnitude of force that can be applied to the handle (10 or 11) and thereby increases weight bearing for off-loading on the lower extremity joints and increases stability. It is the amount of downward force that can be transmitted by the handle (10 or 11) and pole 56 to the ground that results in a decrease in the dynamic knee joint loading.

Pole Selection

As explained above, the more force an ergonomic handle (10 or 11) can distribute through a supporting pole 56 while maintaining neutral wrist 42 deviation 52, the more weight a pole 56 is able to support. For this reason, the novel handles (10 or 11) were designed to be used with reinforced mobility poles 56 with button lock 36 securement (FIGS. 10*ab*). Unlike prior art securement means such as flip or twist locks, button lock 36 poles 56 can support up to 200 pounds per pole, and should be used with the disclosed ergonomic handles (10 or 11). The button-lock 36 when properly engaging a button lock hole 58 can support more weight than other poles, and the innovative grip (10 or 11) allows more weight with more control, stability and comfort. The complementary nature of the innovative grip with the pole locking system occurs when the stronger poles are being used instead of canes and walkers, in which the user is placing a lot of their weight or force through the ledge of the grip, and thereby straining their wrist. In addition, if the locking system slides or fails, the user cannot bear the weight through the less ergonomic grip. Users were applying more weight than the twist locking system could bear and many older adults did not have the grip strength to secure the twist locking system due to arthritis in their hands. Other users that have limited grip strength include those with neurological conditions such as strokes, Parkinson's disease, and those with repetitive strain injuries. Other embodiments are not ruled out or similar methods leading to the same result. The preferred materials for constructing said novel device are described. The use of thermoplastic rubber of 90A durometer or similar material to make the handles (10 or 11) provided the optimal balance between the strength needed in the pommel 14 and flexibility needed in the grip region 16 and the ledge 22. In addition, the 90A durometer material increased weight bearing capacity and stability of the handles (10 or 11).

Other advantages of using the novel ergonomic handles over other methods or devices will now be described. The reinforced mobility poles 56 were developed specifically for rehabilitation and to enhance mobility for conditions that affect balance such as Parkinson's, strokes, Multiple Scoliosis, and later stages of diabetes as well as for older adults. Rehabilitation use includes pre and post-surgery such as hip and knee replacements and spinal stenosis.

The handles (10 or 11) were designed to be used in conjunction with a specific technique developed to increase stability and force offloading. The technique consists of using the poles 56 in an upright position with the arm bent with a 90-degree angle at the elbow. The user moves his arm and legs in the same gait pattern as regular walking, i.e., opposite arm and leg. While swinging the arm forward and in front of the body, the user's weight bears through the support ledge 22 of a handle. This technique allows for a greater downward force to be placed onto the handle.

The poles 56 include other design features which support the above rehabilitation technique. The bell-shaped balance tips 38 support the poles 56 in an upright position and have a wider surface area for balance (FIG. 10*a*). With each handle (10 or 11), the wrist 42 is maintained in a neutral position through the normal gait pattern even when higher rates of force is applied to the ledge 22. Poles 56 designed to be used with ergonomic handles (10 or 11) also promote an upright posture, functional walking pattern of opposite arm and leg, normal heel-toe pattern, and arm swing.

Ergonomic handles (10 or 11) may also be used with the Urban Poles such as the Series 300, 4Life and Adventures poles (all trademarks of Urban Poling Inc., North Vancouver, BC Canada) in conjunction with the Nordic walking technique. In this technique the user applies a downward pressure on the support ledge 22 while the poles 56 are inclined backwards diagonally in order to strengthen the muscles of the upper extremities. The ergonomic shape of the grip region 16 allows the user to maintain a loose grip so that force can be supported by the ledge 22 rather than by a tighter grip which results in muscle fatigue of the hand 40 and the wrist 42. The increased surface area of the ledge 22 supporting the heel of the hand 40 allows for increased force to be applied to the pole and resulting in increased resistance training to the upper extremity muscles. The slight slope angled on the rear of the ledge (incline ledge 30) fits under the heel of the hand 40 and results in a more comfortable shape for applying pressure when the poles are in a diagonal position as well when being used in a horizontal position.

Top holding by means of the pommel 14 provides alternate hand position for descending steep hills and to reduce user fatigue during more intense walking sessions or during long distance hiking. The pommel 14 also fits into the hand comfortably when the pole is in a diagonal position with the wrist maintained in a neutral position. During exercises, to increase range of motion and balance, top holding allows the user to maintain a more upright posture during balance exercises which improves stability. Top holding versus sideways holding allows the user to reach out further to achieve greater range of motion during flexibility exercises.

In testing of the present handles, subject users were instrumented with the wrist goniometer measuring real-time wrist flexion and extension as well as ulnar and radial deviation. Force sensors were also placed on the subjects across the ulnar side of the hand, close to the wrist crease, the middle and the just below the first knuckle. The subjects were asked to produce average and maximal forces with each of the poles in a variety of ground conditions or slope. Ground forces were measured using a scale. The distribution of force across the hand was more even for the present handle than the Exerstrider for all subjects in all activities. The subjects were not able to produce force at the wrist crease position at all with the Exerstrider poles for any of the activities. Force exertion in the wrist crease area is more useful than at the knuckle for both for comfort and for maintaining the force. Going uphill was the activity where the present handles on walking poles were most supportive at the wrist crease. The forces at the knuckle were higher on the Exerstrider than the presently handled poles, especially going downhill. High forces in the knuckle area are not as efficient as at the wrist crease and can cause discomfort over time. Ground forces were higher for top holding on the present pole handles compared to side holding on any of the above-described poles. The top holding position of the hands on the pole handles is an effective position for off-loading. Slight increases in extension with the poles having the handles of the present invention were found for both females walking uphill and downhill. The subjects showed slightly reduced radial deviation when walking downstairs with the present handles. Besides the advantages provided by the pommel, the support ledge on the present handles was found to be a successful ergonomic feature, providing a significant difference in terms of force distribution across the hand for all sizes and activities. It is particularly helpful in "off-loading" for larger subjects who have more trouble walking. As well, the subjects perceived the present handles and poles to be more comfortable than prior poles and handles.

As many mobility devices have a negative connotation associated with aging and disabilities it is important that the present handle is not only shaped to function as noted above, but also that it conveys an athletic look, which helps to promote more persistent usage. The use of stronger, easier locking poles combined with the new handles allow the use of specific walking and rehabilitative techniques that provide a better solution than canes, walkers, Nordic walking poles with straps, the Exerstrider handle and the Pacerpole.

The foregoing description of the preferred apparatus and method of implementation should be considered as illustrative only, and not limiting. Other forming techniques and other materials may be employed towards similar ends. Various changes and modifications will occur to those skilled in the art, without departing from the true scope of the invention as defined in the above disclosure, and the following general claims.

The invention claimed is:

1. An ergonomic handle for a mobility device comprising a central column grip region and a lower portion extending outwards, forming a support ledge for an ulnar portion of a user's hand upon the hand gripping the central column grip region in which: a) the handle has a slit cavity that splits the support ledge and extends upward into the central column grip region, and b) the slit cavity is swept upward in an arc from the support ledge and offset from, but parallel to, a longitudinal axis of the central column grip region, the slit cavity being cut in to a depth of approximately 50% of a latitudinal thickness of the handle at a base of the arc, and cut in to a depth diminishing to zero depth at a top of the arc.

2. The ergonomic handle of claim 1, in which the support ledge extends substantially perpendicular to the longitudinal axis of the central column grip region.

3. The ergonomic handle of claim 2, in which: a) the support ledge surrounds most of the lower portion of the ergonomic handle below the central column grip region; b) the support ledge is sloped downward at an incline ledge area of the support ledge, in order to support a rear area of the user's hand adjacent to the user's wrist; c) the central column grip region provides a side-holding position for the user's hand on the handle, the central column grip region having an upper portion that is joined to a pommel that provides provide a top-holding position for the user's hand on the handle; and d) the pommel is oval-shaped to provide bi-directional gripping of the pommel by the user's hand.

4. The ergonomic handle of claim 3, further comprising a flared sector on a dorsal portion of the central column grip region, in which: a) the central column grip region has a textured surface on medial and lateral portions of the central column grip region to increase resistance for a palm of the user's hand; b) the support ledge is approximately 82 mm. in length from a front edge of the support ledge to its opposite dorsal edge; c) the ergonomic handle is made of thermoplastic rubber of 90A durometer in order to provide a balance of strength and flexibility in the central column grip region and in the support ledge.

5. The ergonomic handle of claim 4, paired with a second such handle, in which the ergonomic handle and the second such handle are symmetrically shaped to fit respective left and right hands of the user and the ergonomic handle and the second such handle are respectively mounted on each pole of a pair of walking poles, the walking poles being reinforced adjustable-length mobility devices with button lock securement of their respective pole length segments.

6. The ergonomic handle of claim 1, in which the support ledge surrounds most of the lower portion of the ergonomic handle below the central column grip region.

7. The ergonomic handle of claim 1, in which the support ledge is sloped downward at an incline ledge area of the support ledge, in order to support a rear area of the user's hand adjacent to the user's wrist.

8. The ergonomic handle of claim 1, in which the support ledge is approximately 82 mm. in length from a front edge of the support ledge to its opposite dorsal edge.

9. The ergonomic handle of claim 1, in which the central column grip region provides a side-holding position for the user's hand on the handle, the central column grip region having an upper portion that is joined to a pommel that provides provide a top-holding position for the user's hand on the handle.

10. The ergonomic handle of claim 9, in which the pommel is oval-shaped to provide bi-directional gripping of the pommel by the user's hand.

11. The ergonomic handle of claim 1, further comprising a flared sector on a dorsal portion of the central column grip region.

12. The ergonomic handle of claim 1, in which the central column grip region has a textured surface on medial and lateral portions of the central column grip region to increase resistance for a palm of the user's hand.

13. The ergonomic handle of claim 1, paired with a second such handle, in which the ergonomic handle and the second such handle are symmetrically shaped to fit respective left and right hands of the user.

14. The ergonomic handle of claim 1, wherein the ergonomic handle is made of thermoplastic rubber of 90A durometer in order to provide a balance of strength and flexibility in the central column grip region and in the support ledge.

15. The ergonomic handle of claim 1, wherein the ergonomic handle is mounted on top of a mobility device that is a walking pole.

16. The ergonomic handle of claim 15, in which the walking pole is a reinforced adjustable-length mobility device with button lock securement of pole length segments.

* * * * *